US006378951B1

(12) United States Patent
Bouyoucos et al.

(10) Patent No.: US 6,378,951 B1
(45) Date of Patent: Apr. 30, 2002

(54) VIBRATORY PAVEMENT BREAKER

(75) Inventors: John V. Bouyoucos, Rochester; Dennis R. Courtright, Canandagua, both of NY (US)

(73) Assignee: Hydroacoustics, Inc., Rochester, NY (US)

( * ) Notice: Subject to any disclaimer, the term of this patent is extended or adjusted under 35 U.S.C. 154(b) by 0 days.

(21) Appl. No.: 09/403,477

(22) PCT Filed: Jun. 19, 1998

(86) PCT No.: PCT/US98/12994

§ 371 Date: Oct. 21, 1999

§ 102(e) Date: Oct. 21, 1999

(87) PCT Pub. No.: WO99/05363

PCT Pub. Date: Feb. 4, 1999

Related U.S. Application Data

(60) Provisional application No. 60/061,785, filed on Jul. 23, 1997.

(51) Int. Cl.[7] ..... E01C 23/12

(52) U.S. Cl. ..... 299/37.2; 299/37.4; 173/206; 173/212

(58) Field of Search ..... 299/36.1, 37.1, 299/37.3, 37.4, 37.5; 173/200, 204, 206, 212, 210; 404/90

(56) References Cited

U.S. PATENT DOCUMENTS

| | | | | | |
|---|---|---|---|---|---|
| 172,869 | A | * | 2/1876 | Cole | 172/697 |
| 3,456,741 | A | * | 7/1969 | James | 173/200 |
| 3,911,789 | A | * | 10/1975 | Boutoucos | 91/321 |
| 4,515,408 | A | * | 5/1985 | Gurries | 299/37.2 |
| 4,650,008 | A | * | 3/1987 | Simson | 173/200 |
| 4,679,857 | A | * | 7/1987 | Roussin et al. | 173/200 |
| 4,732,506 | A | * | 3/1988 | Bays | 404/90 |
| 4,906,049 | A | * | 3/1990 | Anderson | 299/37.2 |

* cited by examiner

*Primary Examiner*—David Bagnell
*Assistant Examiner*—John Kreck
(74) *Attorney, Agent, or Firm*—M. Lukacher

(57) ABSTRACT

An electrohydraulic pavement breaker system having cavities (28, 30) which are filled with hydraulic fluid (oil) or gas, and which provide mass spring system which is resonant at a frequency which is especially adapted for breaking and rubblizing concrete pavement. The resonant mass (18) is in impacting relationship with the pavement through a shoe (12), which shoe (12) may be part of an assembly which is pivotally mounted on the support structure (10) of the breaker and is vibrated with the mass (18) to repeatedly impact the pavement at the rate of the resonant frequency. An electrohydraulic control system is responsive to the motion and average position of the mass of the vibrator and controls the driving force so as to be at the resonant frequency of the mass spring system and have the amplitude and energy suitable for breaking the pavement.

20 Claims, 10 Drawing Sheets

VIBRATORY PAVEMENT BREAKER

This application claims the benefit of priority to provisional application Serial No. 60/061,785, filed Jul. 23, 1997.

DESCRIPTION

The present invention relates to-vibratory pavement breakers and particularly to an electrohydraulic vibratory pavement breaking system with pneumatic or hydraulic springs, providing, with the vibratory mass of the breaker, a system tuned to a resonant frequency especially suitable for pavement breaking.

Vibratory pavement breakers which have heretofore been proposed utilize a vibratory beam which is flexed, much like a violin string, by a rotatably driven eccentric weight at one end of the beam. The opposite end of the beam is arranged to impact the pavement to be broken. The beams of such pavement breakers are supported on shafts by bearings and are subject to forces which tend to rupture or otherwise destroy the bearing material and the shafts. The reliability of such vibratory beam breakers is therefore less than desirable. Such vibratory beam devices are shown for example in U.S. Pat. No. 4,515,408 issued May 7, 1985 to R. A. Gurries.

Hydraulic oscillators have also been used in percussive tools for earth boring and pile driving. There a hammer and anvil system is utilized. Such percussive tools are described, for example, in U.S. Pat. Nos. 3,386,339 issued Jun. 4, 1968 to R. L. Selsam, U.S. Pat. No. 3,371,726 issued Mar. 5, 1968 to J. V. Bouyoucos, U.S. Pat. No. 3,382,932 issued May 14, 1968 to B. A. Wise, U.S. Pat. No. RE 30109, issued Oct. 9, 1979 to J. V. Bouyoucos, et al., U.S. Pat. No. 3,903,972, issued Sep. 9, 1975 to J. V. Bouyoucos, et al. and U.S. Pat. No. 3,911,789 issued Oct. 14, 1975 to J. V. Bouyoucos. The hydraulic oscillator is a free running device which embodies an oscillating valve-hammer which impacts an anvil at one end of the cycle of hammer oscillation. A free running hydraulic oscillator is not desirable for pavement breaking. For pavement breaking, control of the vibratory frequency as well as the vibratory displacement is required in order to consistently break the concrete into rubble size particles. Such rubble has been found desirable so as to provide a bed which is compacted and upon which an asphalt surface may be laid.

It is the principal object of the invention to provide a system reliably operative for breaking and rubblizing highway pavement.

It is another object of the present invention to provide an improved vibratory pavement breaker which is electrohydraulically. driven and controlled and which utilizes a mass resonant with a spring system, the springs being either hydraulic or pneumatic and the mass being driven electrohydraulically via a control system, which may be a feedback control system, for maintaining the vibration at the resonant frequency with the amplitude and position thereof in impacting relationship with the pavement to be rubblized.

It is the further object of the invention to provide an improved electrohydraulic pavement breaker system with a plurality of pavement breakers arranged in an array on a vehicle so that the array is advanced along the pavement to be broken and rubblized to break a swath of pavement equal in size to the width of the breakers across the swath.

It is a still further object of the present invention to provide an improved pavement breaker having a mass which is reciprocally driven toward and away from the pavement and which provides the vibratory forces against the pavement via a pivoted link which can drag along the pavement and isolates the driver including its mass from the pavement thereby reducing excessive sidewise forces on the surfaces (bearing surfaces) over which the mass moves as it is vibrated.

It should be understood that one or more of the forgoing objects, and not necessarily all thereof, may be achieved in accordance with the invention.

The foregoing and other objects, features and advantages of the invention will be more apparent from a reading of the following description in connection with the accompanying drawings in which.

Figure 6:
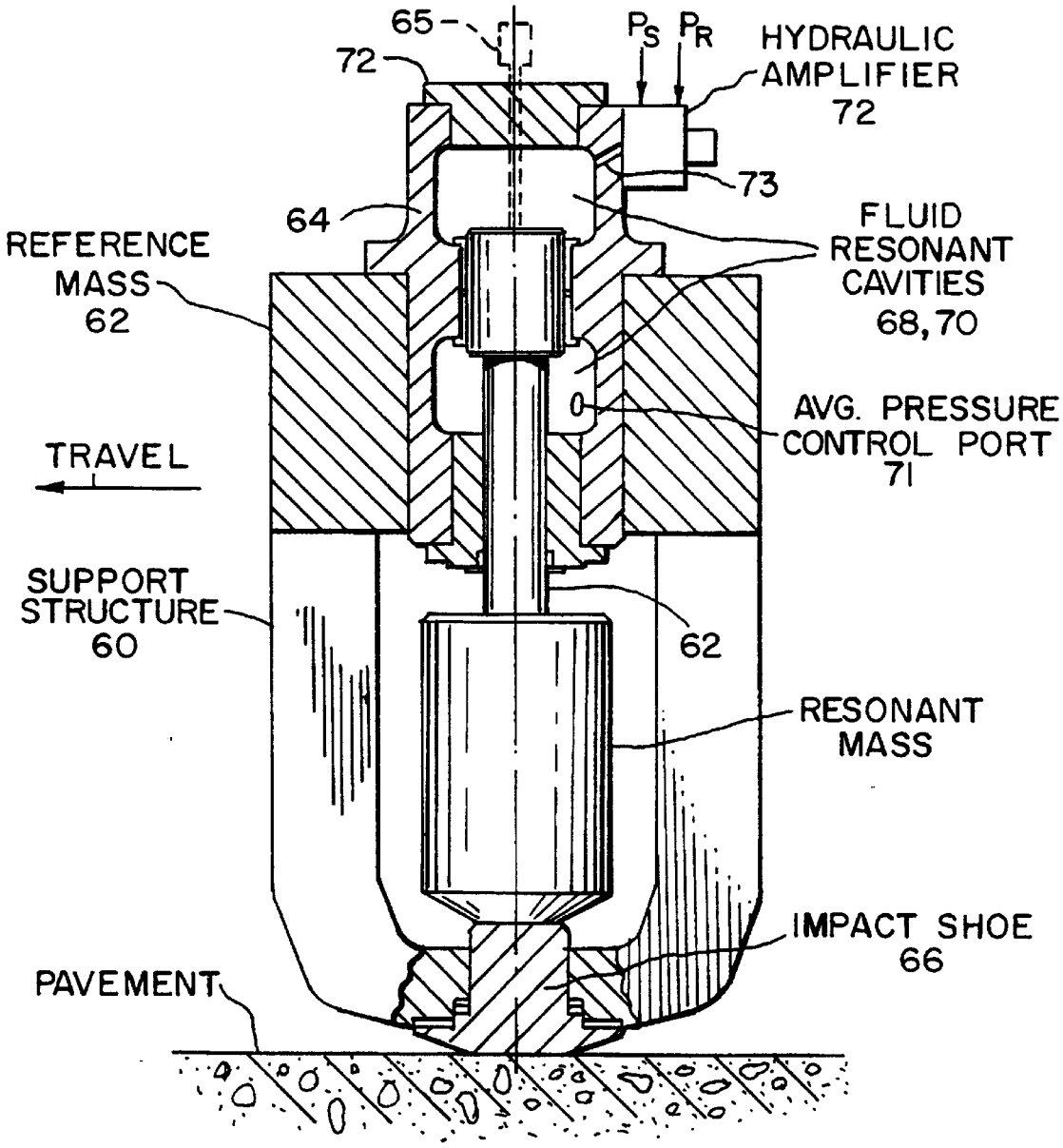
FIG. 6 is a sectional view similar to FIG. 4 showing an electrohydraulic pavement breaker in accordance with another embodiment of the invention.
Figure 7:
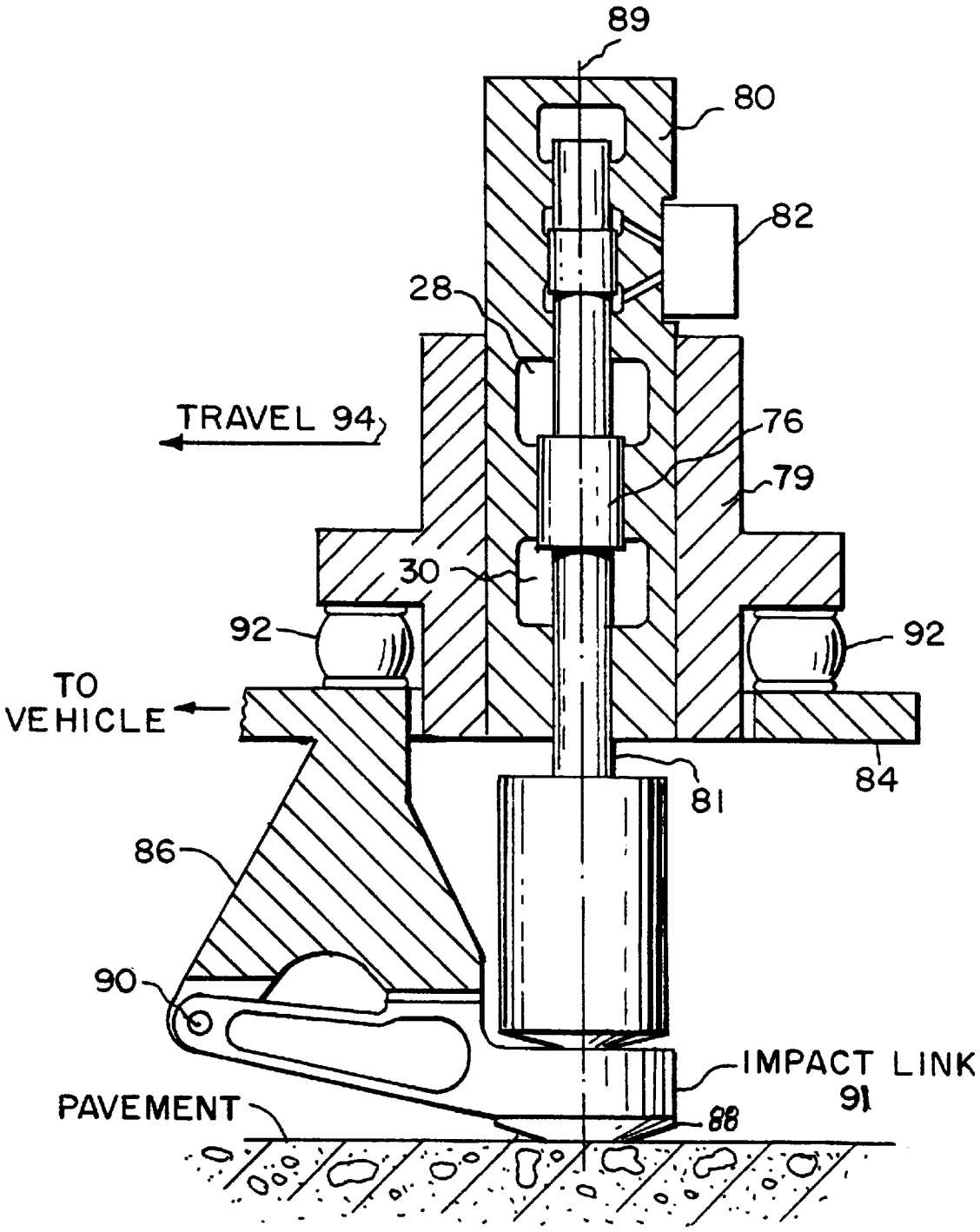
Figure 8:
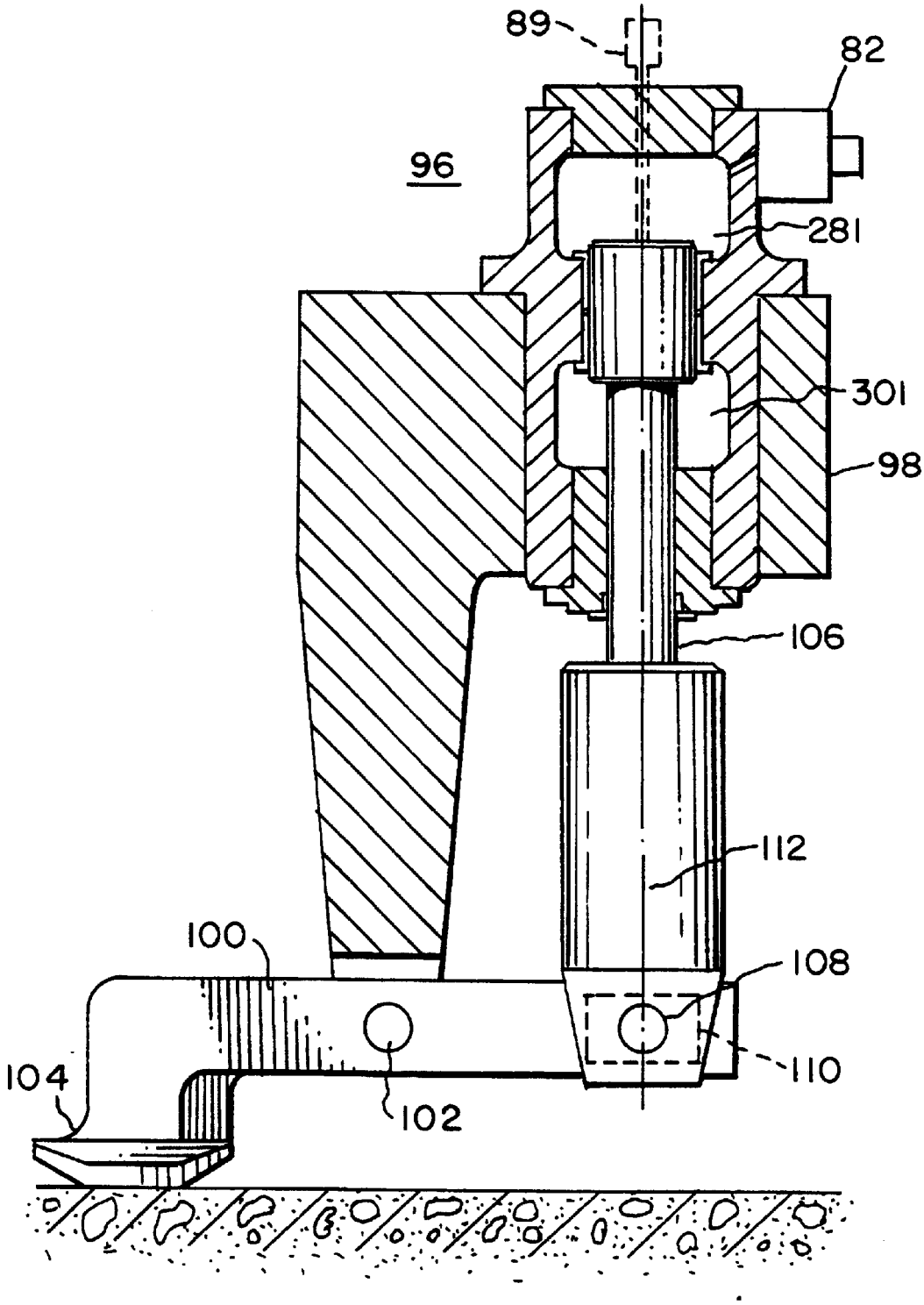
Figure 9:
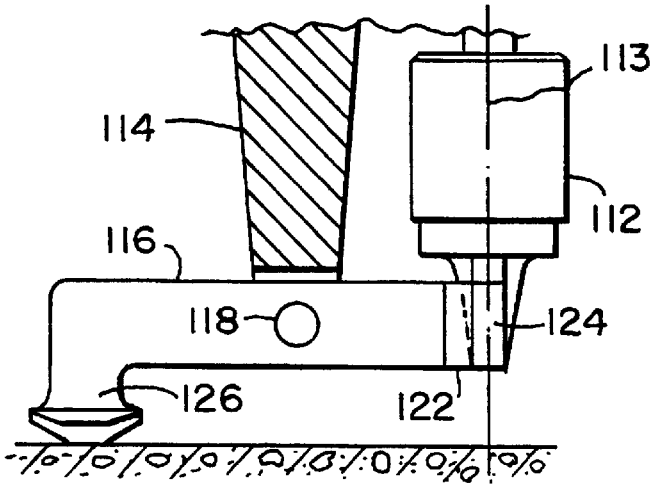
Figure 10:
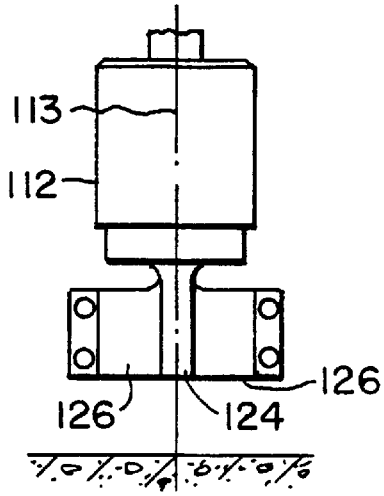
Figure 11:
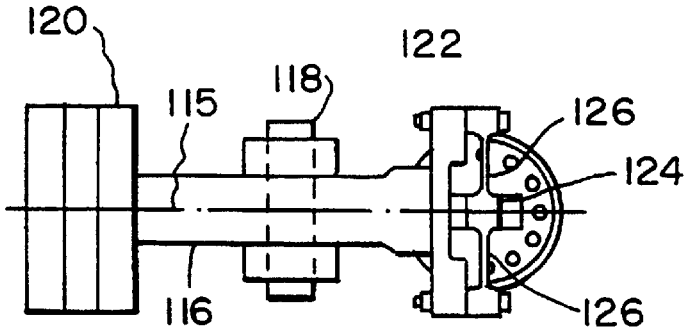
Figure 13:
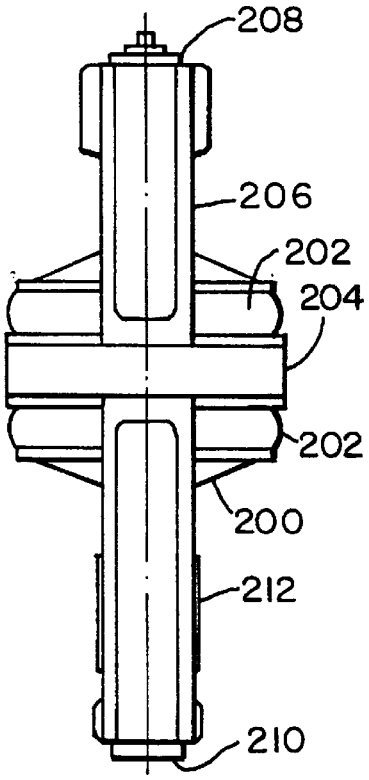
Figure 12:
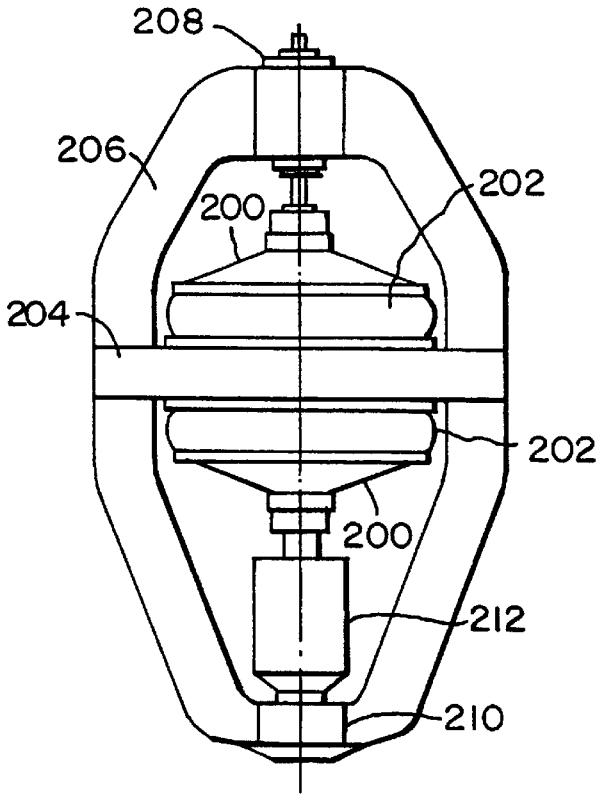
Figure 14:
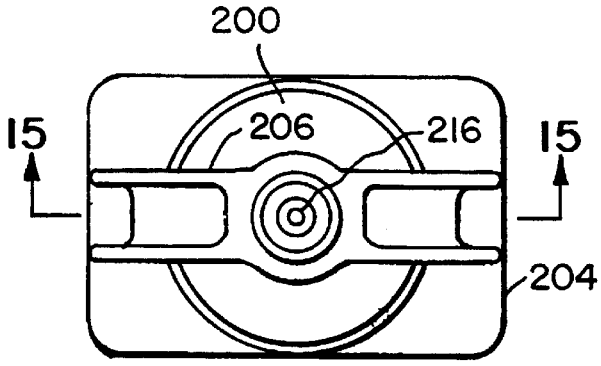
Figure 15:
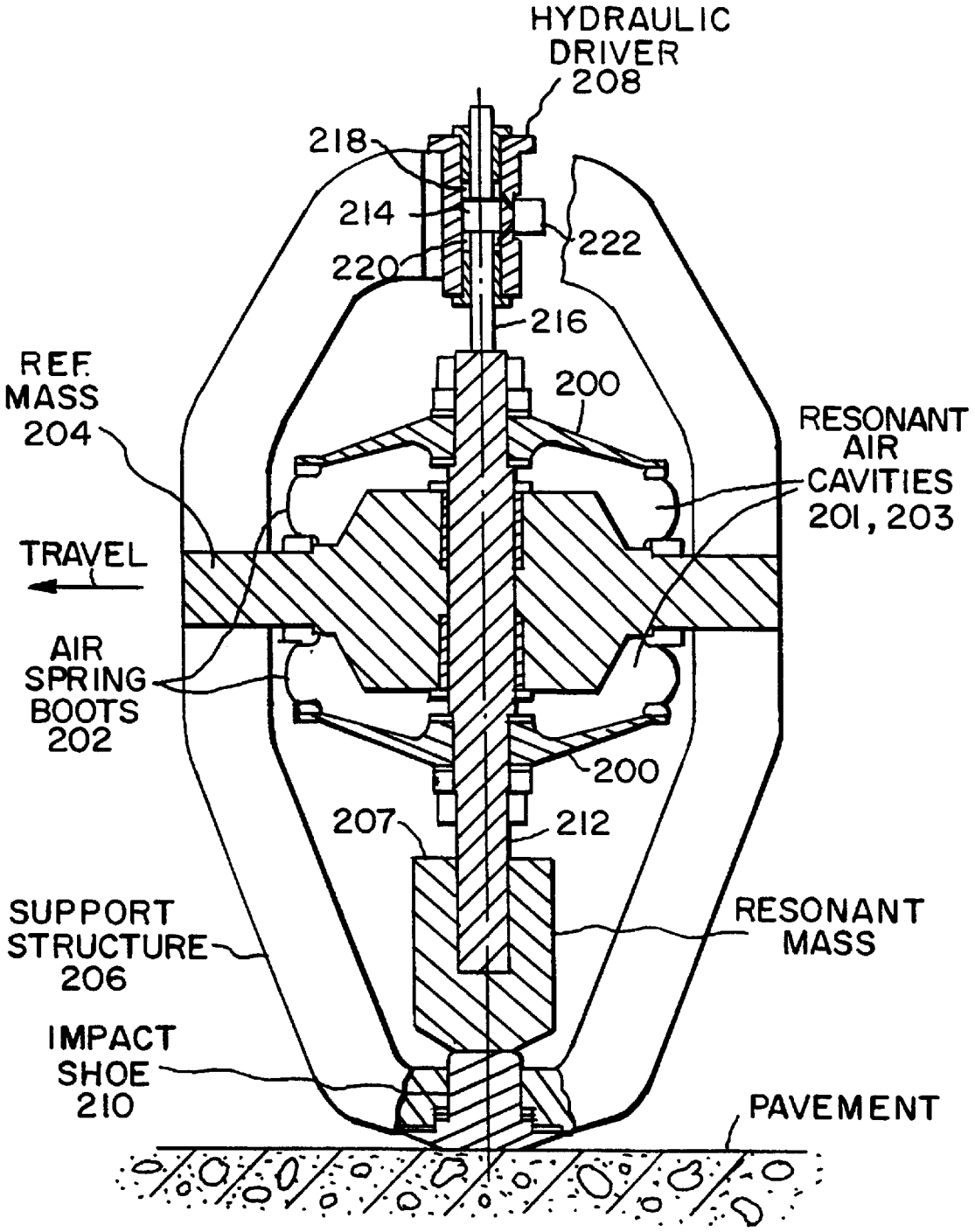
Figure 16:
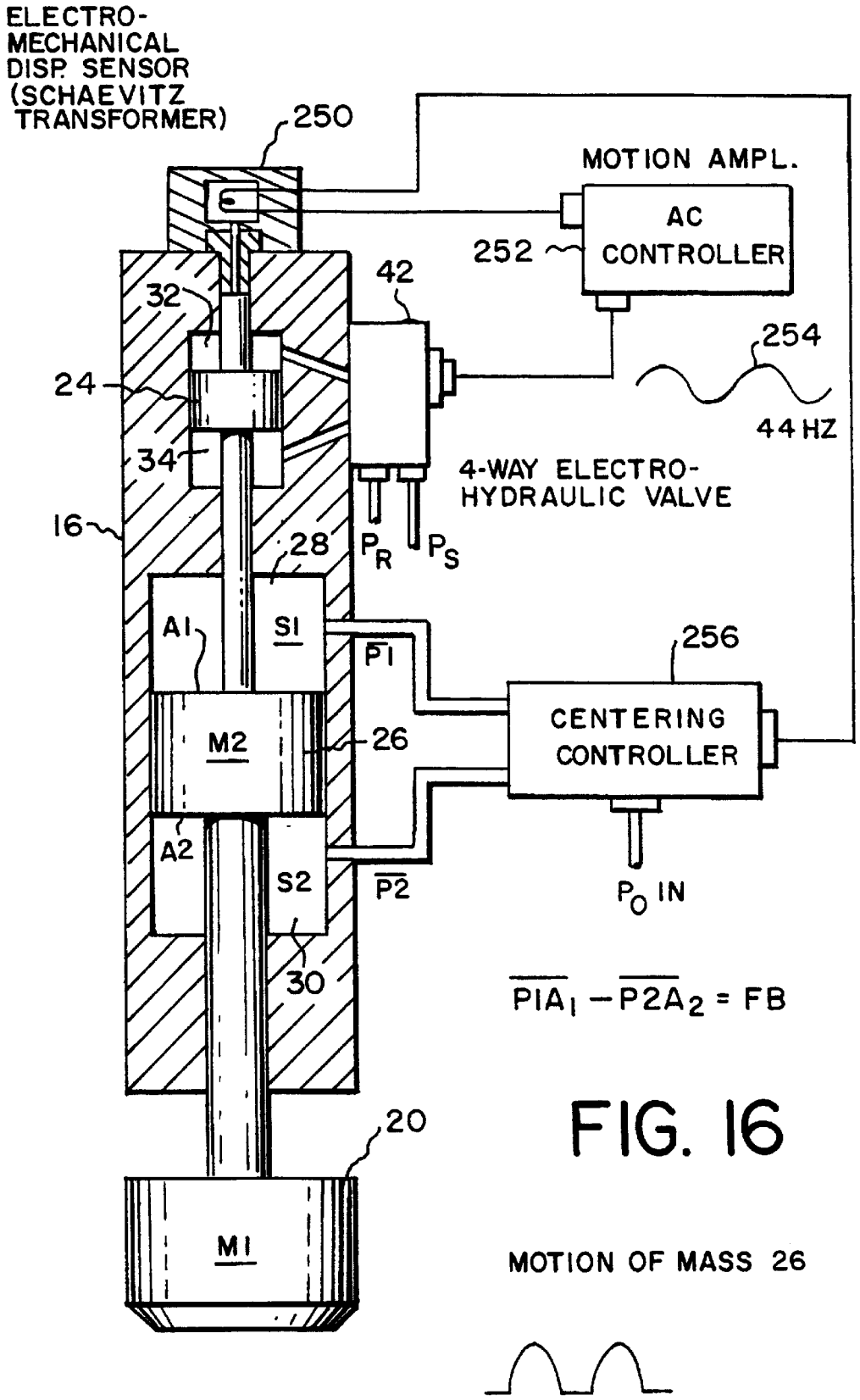

FIG. 7 is a sectional view, in elevation, showing a pavement breaker similar to the pavement breaker shown in FIGS. 1 through 4 having a pivotable link for transferring vibratory forces between the oscillating mass of the breaker and the pavement while isolating forces on the oscillation mass in a direction transverse to the direction in which the mass reciprocates (vertically) with respect to the pavement;

FIG. 8 is a sectional view in elevation of an electrohydraulic pavement breaker similar to that shown in FIG. 6 having a link mechanism in accordance with another embodiment of the invention for coupling the reciprocating mass to the pavement while isolating the mass from forces in a direction transverse to its axis of reciprocating vibration;

FIGS. 9, 10 and 11 are respectively front elevational, side elevational and bottom plan views of another link mechanism which is connected to the vibratory mass of a vibratory pavement breaker, all in accordance with the invention;

FIGS. 12, 13 and 14 are respectively front elevational, side elevational and top plan views of a vibratory pavement breaker which is electrohydraulically driven and has pneumatic springs;

FIG. 15 is a sectional view through the pavement breaker shown in FIGS. 12 to 14, the view being taken along line 15–15 in FIG. 14; and FIG. 16 is a schematic diagram of an electrohydraulically driven pavement breaker system embodying the invention.

Referring to FIGS. 1 through 4 the electrohydraulic pavement breaker is provided by a support structure 10 which is generally U-shaped and holds, at the end thereof facing the pavement, an impact shoe 12. The shoe is reciprocally mounted in the support structure. The upper end of the support structure holds a reference mass 14. The mass and the support structure may be attached to the body of a vehicle which is driven over the highway for pavement breaking and rubblizing by operating the breaker. It may be desirable to isolate the reference mass and also a housing 16 of the breaker in which a mass 18 is supported for reciprocal movement along an axis 20. Such isolation may be provided by shock mounts between the mass and the chassis or frame of the vehicle. See e.g. FIG. 7, discussed hereinafter.

The mass 18 includes a lower body 21 attached to a shaft 22 on which upper and lower pistons 24 and 26 are disposed. The lower piston 26 has upper and lower faces which are exposed to fluid (in case of this embodiment, hydraulic fluid such as oil) filled cavities 28 and 30. The faces of the upper piston 24 are also exposed to hydraulic fluid filled cavities 32 and 34. A cap 36 covers the upper end of the housing 16 and may be air filled but may contain some fluid which leaks through the peripheral surfaces which provide bearings which guide the mass 18 in the housing 16. These surfaces may be lined with sleeves or bearings, such as a lower sleeve 38 which plugs the lower cavity 30. A coupling may be provided between the shaft portion 40 and the center piston 26 decoupling the upper part of the mass from the lower part thereof and allowing sufficient sidewise movement of the lower part of the mass to accommodate misalignment, either in manufacture or during operation because of the sidewise forces transferred to the mass by the pavement as vibratory forces are applied thereto.

The fluid in the cavities, principally the cavities 28 and 30, has a stiffness which is resonant with the vibratory mass 18 at a frequency which has been found especially suitable for pavement breaking and rubblizing. This frequency may be between 40 and 50 Hz with 44 Hz being found to be most suitable. The forces for driving the mass at the resonant frequency are supplied via a hydraulic amplifier 42. This amplifier may be electrically driven and controlled as further described hereinafter in connection with FIG. 16. The amplifier may be a hydraulic amplifier such as a solenoid driven four-way valve, which switches the pressure in the cavities 32 and 34 between supply pressure and return pressure, such pressure being provided by a hydraulic pump. Differential static or DC pressure may be provided in the cavities 28 and 30 so as to bias the mass toward the pavement, through the hydraulic springs provided by the cavities 28 and 30. The pressures may be controlled in accordance with the areas of the piston 26 facing the cavities 28 and 30 so as to provide for centering of the pistons in the housing bore, as well as biasing of the mass, as will be discussed hereinafter in connection with FIG. 16.

The following parameters may for example be suitable for a system as shown in FIGS. 1—4: Total Weight-18,000 pounds; Weight of Resonant Mass 18—3,000 pounds; peak stroke of vibration of resonant mass—0.354 inches; peak kinetic energy developed in resonant mass 19—3,100 foot pounds; and resonant frequency of vibration—44$H_z$; height–9 feet 4 inches, front and side lengths—3 feet 10 inches by 2 feet, 6 inches.

Figure 2:
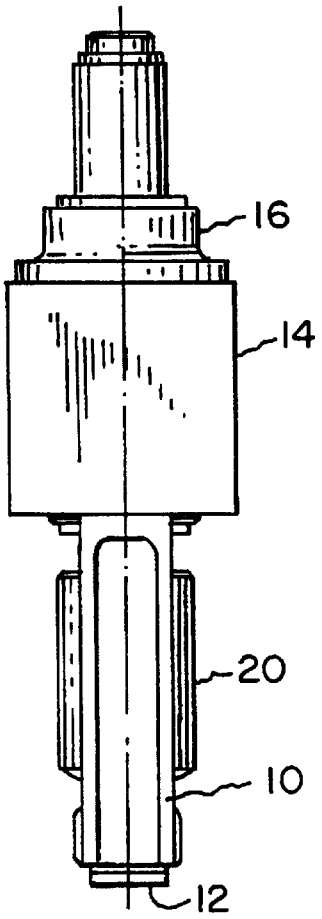
FIGS. 1, 2 and 3 are respectively a front elevation, a side elevation and a top view of an electrohydraulic pavement breaker embodying the invention.
Figure 1:
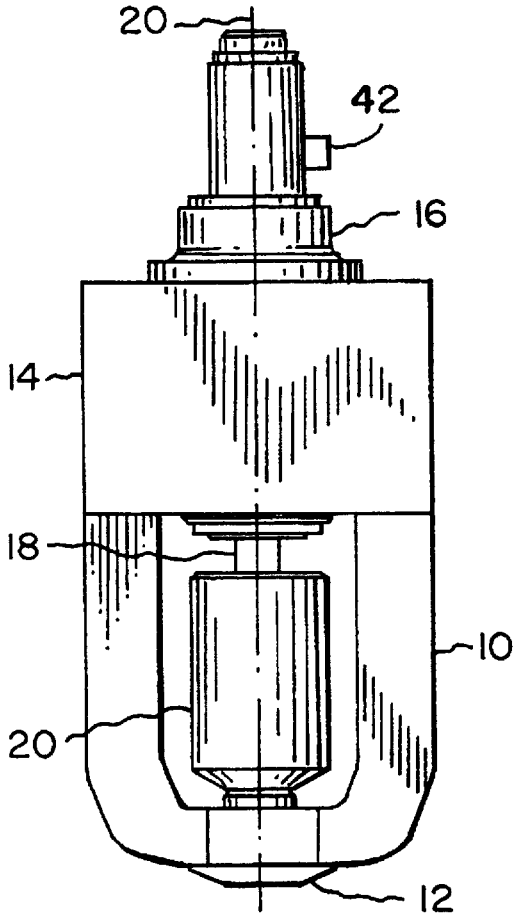
Figure 3:
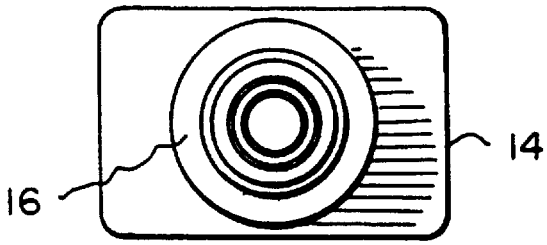
Figure 4:
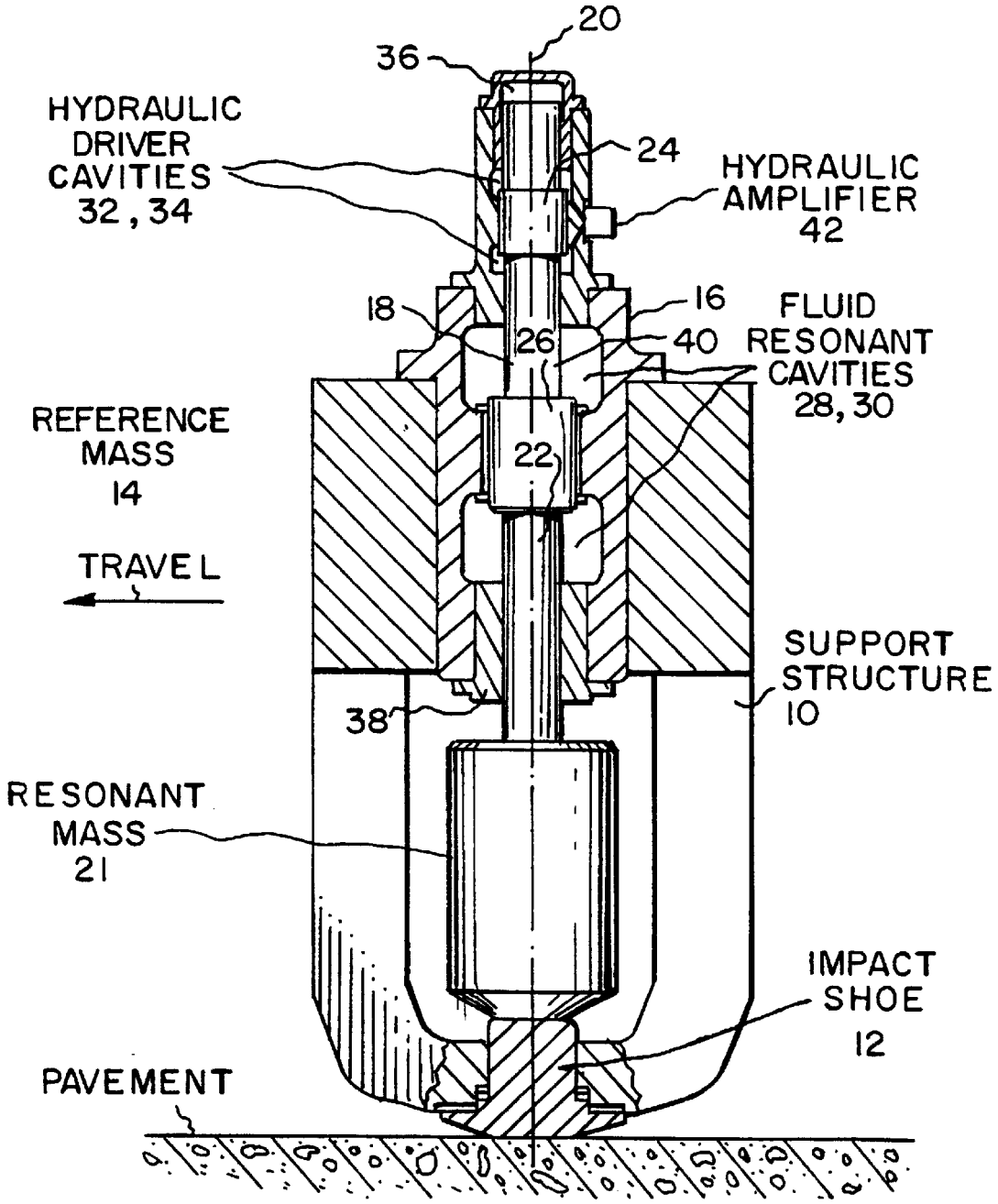
FIG. 4 is a sectional view through the pavement breaker shown in FIGS. 1 to 3.
Figure 5:
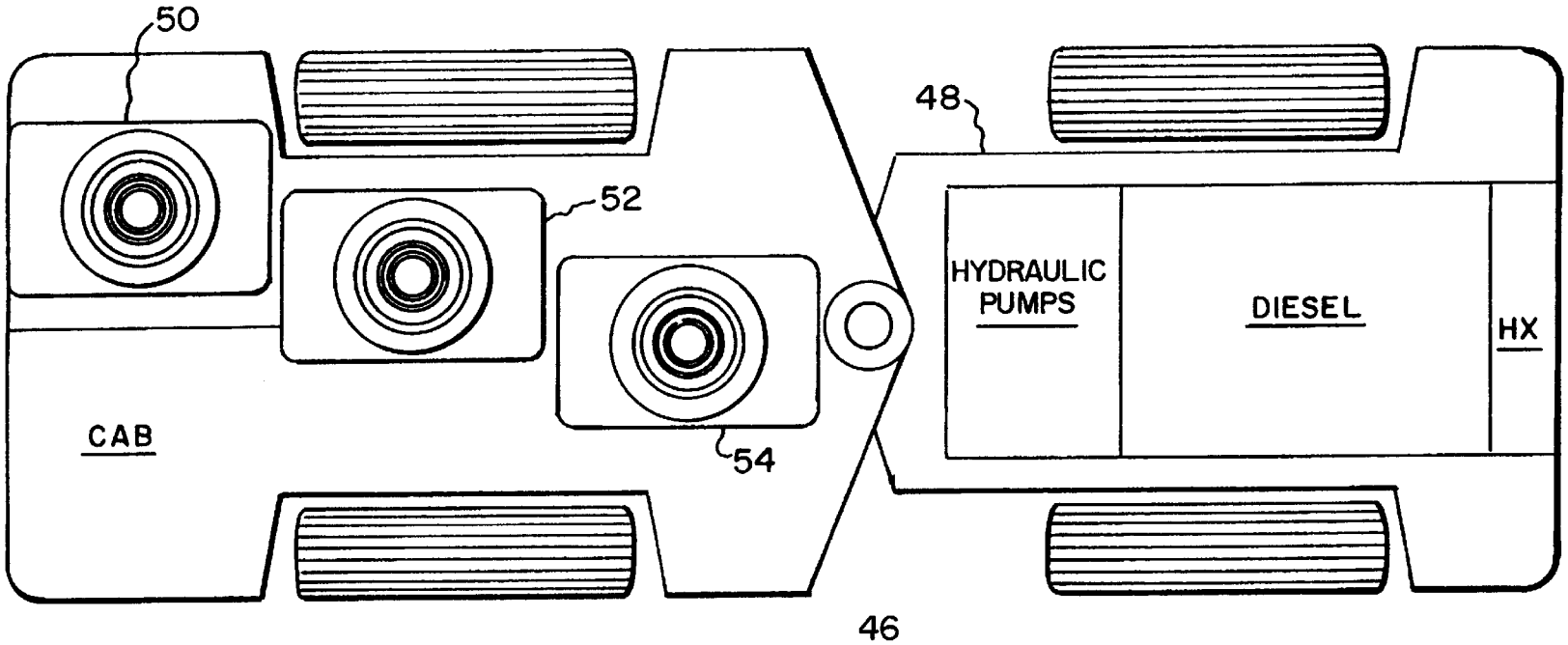
FIG. 5 is a schematic, plan view showing a staggered array of pavement breakers on a vehicle which moves the array along the highway.

Referring to FIG. 5 there is shown a vehicle made up of a tractor 46 and a trailer 48; The tractor receives power from hydraulic pumps and a diesel engine, which together with a heat exchanger, are mounted on the trailer 48. An array of three laterally offset pavement breakers 50, 52 and 54, each like the breaker shown in FIGS. 1 through 4, is mounted on the tractor and are in laterally overlapping relationships so as to break and rubblize a swath of width equaled to the total width of the pavement which the modules, 50, 52 and 54 overlie.

Referring to FIG. 6, there is shown a support structure 60 and a reference mass 62 which supports a housing 64. The vibratory resonant mass 61 is biased against pavement via an impact shoe 66. The housing has hydraulic fluid-filled cavities 68 and 70. The bias is applied by controlling the DC pressure in the cavities 68 and 70. Only the pressure in cavity 70 needs to be controlled via port 71 to set the bias force. The upper cavity is closed by a cap 72. A position and motion sensor 65 may be coupled to the resonant mass 61. This sensor 65 may be used in a system for controlling an electrohydraulic valve 72 which provides the functions of a hydraulic amplifier to switch the connection 73 joining cavity 68 and amplifier 72, between supply and return pressures, $P_s$ and $P_R$. The amplifier thus varies the pressure in the upper cavity 68 at a rate equal to the resonant frequency determined by the mass 61 and the stiffness of the fluid in the cavities 68 and 70, so as to produce resonant vibratory motion of the mass 61.

Referring to FIG. 7, there is shown an electrohydraulic vibrator-pavement breaker having a housing 80 and a resonant mass and hydraulic system similar to that described in connection with FIG. 4. The mass is driven to vibrate by the vibratory hydraulic energy provided by a hydraulic amplifier 82.

The frame or chassis 84 of the vehicle is connected to a support 86 on which a shoe 88 on the end of a link 99 is mounted to pivot about an axis 90. horizontal to the pavement. The support also acts as a stop for the movement of the shoe in the vertical direction. The reference mass 79 of the hydraulic vibrator is connected to the frame 84 by shock mounts 92. These shock mounts are vibration isolators and may be located at a plurality of stations around the axis of vibration 89 of the vibrating mass 81.

In operation, the vehicle travels in the direction shown by the arrow 94. The shoe is then dragged along the pavement and is maintained in contact with the pavement due to the weight of the mass 81 and the hydraulic bias forces, which forces are due to the differential pressure acting on the opposed areas of the piston 26. The shoe 88 may be subject to sidewise forces or the forces arising from dragging the shoe along the pavement. However, such sidewise or drag forces are not transferred to the vibratory mass 81 but rather are constrained by the coupling pin 90 which transfers such drag directly to the vehicle platform 84. Since the shoe drags along the pavement, it may follow a contour or profile of the pavement and maintain contact with the pavements so as to facilitate breaking and rubblization thereof. The location of the pivot 90 ahead of the shoe insures that the contour of the pavement will be followed.

Referring to FIG. 8, there is shown a hydraulic vibrator 96 where the reference mass 98 is attached to a rocker arm 100 at a rotary bearing 108. The rocker arm is caused to pivot about a rotary. bearing 102. A shoe 104 is attached to the opposite end of rocker arm 100. Accordingly, oscillating mass 112, driven electrohydraulically by the combination of the amplifier 82 and the mass-spring oscillator including the liquid spring cavities 281 and 301, causes shoe 104 to oscillate on a pavement load, fracturing the pavement through repetitive impact. The rocker arm 100 is mounted on the support structure by a first pivot 102. A dashed line 110 indicates a slot in which the bearing 108 may be movable in a transverse (side wise) direction so as to accommodate the arc over which the connection (of the arm 100 to the mass 106) moves, since this arc is not totally coincident with the axis of vibration 112 of the vibratory mass 106.

Referring to FIGS. 9, 10 and 11, there is shown a vibratory mass 112, a support structure 114 and a rocker arm 116 mounted on a pivot 118 centrally thereof to the support structure. The shoe 120 of the rocker arm engages the pavement. The end of the rocker arm opposite to the shoe has a flange 122. This flange is connected to a nose portion 124 which depends from the mass 112. The nose has flexible side pieces 126 which are attached to the flange at the outer ends thereof. The nose and side pieces provide a flexural connection to the end of the beam 116 and allow it to execute transverse movement as well as to swing independently and in isolated relationship with the vibratory mass 112. The nose is stiff in the direction of vibration (along the axis 113), but flexural in the direction transverse to that axis, that is especially in the forward and reverse direction along an axis 115 perpendicular to the axis 113. There is also sufficient flexure to enable twisting movement about the axis 113. The rocker arms 100 & 116 serve purposes like that of the link 91 and shoe 88 (FIG. 7).

Referring to FIGS. 12, 13, 14 and 15, there is shown an electrohydraulic vibrator which utilizes the pneumatic springs in pressurized air filled cavities 201 and 203. These cavities are formed by plates 200 and spring boots 202 which are connected to a central framework 204 which also provides the reference mass of the vibrator. The referenced mass is held in a support structure 206, which supports at the upper end thereof, an electrohydraulic driver 208. The lower end of the support structure 206 contains and holds, for reciprocal movement, an impact shoe 210. The vibratory mass 212 is resonant with the springs provided in the cavities 201 and 203. The resonant mass 212 includes an element 207 which is outside of the cavities and which is biased against the impact shoe, suitably by adjusting the pressure in the cavities 201 and 203 so as to provide elastic bias, much like the hydraulic fluid spring cavities 28 and 30 (FIGS. 4 and 16).

The hydraulic drive 208 has a piston 214 which is on a rod 216 extending from the resonant mass 212. The piston 214 faces cavities 218 and 220 on opposite sides of the piston. These cavities are connected to a hydraulic amplifier or driver 222 which may be a solenoid driven four way electrohydraulic valve such as discussed in connection with FIGS. 1–4. The hydraulic amplifier switches the pressure in the cavities 218 and 220 at a rate which is equal to the resonant frequency defined by the mass 212 and the pneumatic springs provided by the cavities 201 and 203.

Shaft 216 may be mechanically connected to the rest of the resonant mass 212 or may be biased against the top of the mass due to the differential forces in the hydraulic fluid filled cavities 218 and 220.

In the case of the electrohydraulically vibrated pavement breaker system shown in FIGS. 1–11 and in the case of the electrohydraulic/ pneumatic pavement breaker shown in FIGS. 12–15, the weight of the pavement breaker including the support structure of the reference mass may be about 13,000 to 18,000 pounds total. The resonant mass itself may weigh about 1,000 to 3,000 pounds. The peak stroke of the resonant mass and therefore the peak stroke of the impact shoe may be of the order of 0.6 inches. Assuming continuous contact between the impact shoe and the resonant mass. The total movement of the resonant mass, peak to peak, may be approximately 1.2 inches or 3 centimeters.

More specifically, the following parameters may, for example be suitable for a system as shown in FIGS. 12–15; total weight—13,600 pounds; weight of resonant mass 212—1000 pounds; peak stroke of vibration of resonant mass—0.613 each; peak kinetic energy developed in resonant mass 212—3100 foot pounds; and resonant frequency of vibrations—44 Hz; height 8 feet, length along sides 4 feet 7 inches by 3 feet.

Referring to FIG. 16 there is shown a structure of an electrohydraulic vibratory pavement breaker. The resonant mass 18 is connected to an electromechanical displacement sensor 250 at the upper end thereof. This displacement sensor may be of the type known as a Schaevitz transformer or LVOT, which provides an output corresponding to the average position as well as an output corresponding to the motion of the resonant mass. The average position signal is referred to as a DC signal since it is essentially constant, while the motion signal is an alternating current or AC signal which follows the motion of the resonant mass. The job of AC controller 252 is to drive the mass by switching the pressures in the cavities 32 and 34 at the resonant frequency, for example 44 Hz, as shown by the waveform at 254. The AC controller provides the output signal which varies in frequency and amplitude in accordance to enable the resonant mass to be maintained at the desired frequency and amplitude of vibration. To this end reference signals may be applied to the controller in accordance with known servo system technology.

The DC position signal from the sensor 250 is applied to a centering controller 256. The centering controller meters hydraulic fluid into the spring cavities 28 and 30. It may be noted that the surface A1 facing the cavity 28 may be of a larger area than the surface A2 facing the lower cavity 30 because of the difference in diameter of the shaft connected to the piston 26 of the mass 18. Accordingly the average pressure P1 into the cavity 28 and the pressure P2 into the cavity 30 creates a differential force P1 A1 minus P2 A2 equal to the bias force FB, which biases the resonant mass towards the pavement. The centering controller may include reference signal generators and valves to provide the requisite force balancing effect.

From the foregoing description it will be apparent that there has been provided an improved electrohydraulic pavement breaker and controllers therefor which provide an integrated system for effective pavement breaking and rubblization. Variations and modifications in the herein described apparatus will undoubtedly suggest themselves to those skilled in the art. Accordingly the foregoing description should be taken as illustrative and not in a limiting sense.

What is claimed is:

1. A pavement breaker comprising a resonant mass and pressurized hydraulic or pneumatic spring system, and a structure which supports said resonant mass-spring system for vibration toward and away from a pavement to be broken; an electrohydraulic driving and control system for driving said mass into vibration at the resonant frequency of said mass-spring system, said spring system comprising pressurized gas or liquid filled cavities, said cavities facing portions of said mass, said resonant frequency being determined by the stiffness of the fluid in said cavities and the mass of said system, an impact link or rocker in continuous contacting relationship with said mass and on to which said mass transfers vibratory force, a shoe on said link or rocker in contacting relationship with said pavement and dragable over said pavement, said link or rocker being mounted on said structure freely pivotal on an axis generally horizontal to the pavement to permit said link to move in a generally vertical direction with respect to said pavement.

2. The breaker according to claim 1 wherein a flexural connection is disposed between said shoe and said resonant mass.

3. The breaker according to claim 1 wherein said pivot axis is located ahead of said mass in the direction of travel of said breaker along said pavement.

4. The breaker according to claim 1 further comprising means flexurally connecting said link and said shoe contacting said pavement and disposed between said mass exclusively for decoupling said mass from sidewise forces transmitted from said pavement as said breaker travels along said pavement.

5. The breaker of claim 1 wherein said resonant frequency in the range of about 40–50 Hz.

6. The breaker according to claim 5 wherein said breaker presents an average force upon said pavement of bout 13,000 to 18,000 pounds.

7. The breaker according to claim 6 wherein said resonant mass reciprocates toward and away from said pavement over a stroke of from about 0.6 to 1.2 inches.

8. The breaker of claim 7 wherein said resonant frequency is about 44 Hz.

9. The breaker according to claim 1 further comprising fluid pressure applying means for positioning and for biasing said mass toward said pavement.

10. The breaker according to claim 9 where said pressure applying means provides pressure which varies dynamically at said resonance frequency.

11. The breaker according to claim 1 wherein said electrohydraulic system includes fluid pressure applying means operative to vary pressure in said cavities.

12. The breaker according to claim 1 wherein said structure includes a reference mass heavier than said resonant mass.

13. The breaker according to claim 12 wherein means for connecting said breaker to a vehicle which transports said breaker along said pavement includes shock mounts mechanically connecting said reference mass to said vehicle.

14. The breaker according to claim 12 wherein said link or rocker arm is pivotably connected to said reference mass, said shoe being carried by said link or arm into contact with said pavement, and said resonant mass being in engagement with said link or arm for transferring vibratory force to said shoe.

15. The breaker according to claim 14 wherein a coupling provided by a flexure or a rotary bearing provides engagement of said link or arm and said resonant mass.

16. The apparatus according to claim 1 further compressing a plurality of said breakers disposed in an array which extends in a direction across the pavement.

17. A pavement breaker comprising a resonant mass and pressurized hydraulic or pneumatic spring system having a resonant frequency, and a structure which supports said resonant mass-spring system for vibration towards and away from a pavement to be broken; an electrohydraulic driving and control system for driving said mass into vibration at the resonant frequency of said mass-spring system, said spring system comprising pressurized gas or liquid filled cavities, said cavities facing portions of said mass, said resonant frequency being determined by the stiffness of the fluid gas in said cavities and the mass of said system, and said cavities are defined by flexible boots surrounding at least a portion of said mass, and said cavities are filled with gas to provide the pneumatic spring system.

18. The breaker according to claim 17 wherein said resonant mass includes a shaft on which first and second portions are disposed, said first portion having opposite faces exposed to said cavities, and fluid drive means including a hydraulic amplifier operative upon said second portion for driving said resonant mass at said resonant frequency.

19. The apparatus according to claim 17 further compressing a plurality of said breakers disposed in an array which extends in a direction across the pavement.

20. A pavement breaker comprising a resonant mass and pressurized hydraulic or pneumatic spring system, and a structure which supports said resonant mass-spring system for vibration towards and away from a pavement to be broken; an electrohydraulic driving and control system for driving said mass into vibration at the resonant frequency of said mass-spring system, said spring system comprising pressurized gas or liquid filled cavities, said cavities facing portions of said mass, said resonant frequency being determined by the stiffness of the fluid in said cavities and the mass of said system, and said control system comprising a displacement sensor coupled to said mass and responsive to the position and movement of said mass, and said control system further comprising servo means responsive to said sensor for controlling dynamic and static pressures applied to said mass to maintain said mass vibrating at said resonant frequency and biased against said pavement.

* * * * *